US005080779A

United States Patent [19]

Awbrey et al.

[11] Patent Number: 5,080,779

[45] Date of Patent: Jan. 14, 1992

[54] METHODS FOR REMOVING IRON FROM CRUDE OIL IN A TWO-STAGE DESALTING SYSTEM

[75] Inventors: Spencer S. Awbrey, Spring; Ronald W. Gropp, The Woodlands, both of Tex.

[73] Assignee: Betz Laboratories, Inc., Trevose, Pa.

[21] Appl. No.: 560,613

[22] Filed: Aug. 1, 1990

[51] Int. Cl.[5] ..... C10G 17/00

[52] U.S. Cl. ..... 208/252; 208/251 R; 208/311; 208/282

[58] Field of Search ..... 208/252, 282, 251 R, 208/311

[56] References Cited

U.S. PATENT DOCUMENTS

| | | | |
|---|---|---|---|
| 2,739,103 | 3/1956 | Thompson | 208/252 |
| 4,276,185 | 6/1981 | Martin | 252/87 |
| 4,342,657 | 8/1982 | Blair, Jr. | 252/8.55 |
| 4,415,434 | 11/1983 | Hargreaves et al. | 208/452 |
| 4,548,700 | 10/1985 | Bearden, Jr. et al. | 208/10 |
| 4,778,590 | 10/1988 | Reynolds et al. | 208/252 |
| 4,789,463 | 12/1988 | Reynolds et al. | 208/282 |
| 4,830,766 | 5/1989 | Gallup et al. | 252/8.552 |
| 4,853,109 | 8/1989 | Reynolds | 208/252 |
| 4,988,433 | 1/1991 | Reynolds et al. | 208/282 |

*Primary Examiner*—Helane E. Myers

*Attorney, Agent, or Firm*—Alexander D. Ricci; Bruce E. Peacock

[57] ABSTRACT

Methods of diminishing the content of soluble and insoluble forms of iron from crude are disclosed. Crude and water soluble chelant are mixed prior to addition of wash water. After wash water addition, an emulsion is formed. After resolution of the emulsion, iron laden water phase is separated resulting in decreased iron content in the crude. In a two-step desalting process, water soluble chelant is mixed with crude separated from the resolved emulsion emanating from the first, upstream, desalter. After such mixing, fresh wash water is added, with the so-formed crude/chelant/wash water mixture being fed to the second, downstream, desalter, for resolution. Crude separated from the second desalter has substantially diminished iron content compared to crude fed to the first desalter.

12 Claims, 1 Drawing Sheet

METHODS FOR REMOVING IRON FROM CRUDE OIL IN A TWO-STAGE DESALTING SYSTEM

FIELD OF THE INVENTION

The present invention pertains to methods for removing iron in crude oil. The invention is particularly useful in a two-stage desalting system wherein water soluble chelants are added to the crude oil downstream from the first stage desalter, but prior to wash water injection into the second stage desalter.

BACKGROUND OF THE INVENTION

All crude oil contains impurities which contribute to corrosion, heat exchanger fouling, furnace coking, catalyst deactivation and product degradation in refinery and other processes. These contaminants are broadly classified as salts, bottom sediment and water (BS+W), solids, and metals. The amounts of these impurities vary depending upon the particular crude. Generally, crude oil salt content ranges between about 3–200 pounds per 1,000 barrels (ptb.).

Brines present in crude include predominantly sodium chloride with lesser amounts of magnesium chloride and calcium chloride being present. Chloride salts are the source of highly corrosive HCl, which is severely damaging to refinery tower trays and other equipment. Additionally, carbonate and sulfate salts may be present in the crude in sufficient quantities to promote crude preheat exchanger scaling.

Solids other than salts are equally harmful. For example, sand, clay, volcanic ash, drilling muds, rust, iron sulfide, metal and scale may be present and can cause fouling, plugging, abrasion, erosion and residual product contamination. As a contributor to waste and pollution, sediment stabilizes emulsions in the form of oil-wetted solids, and can carry significant quantities of oil into the waste recovery systems.

Metals in crude may be inorganic or organometallic compounds which consist of hydrocarbon combinations with arsenic, vanadium, nickel, copper and iron. These materials promote fouling and can cause catalyst poisoning in subsequent refinery processes, such as catalytic cracking methods, and they may also contaminate finished products. The majority of the metals carry as bottoms in refinery processes. When the bottoms are fed, for example, to coker units, contamination of the end-product coke is most undesirable. For example, in the production of high grade electrodes from coke, iron contamination of the coke can lead to electrode degradation and failure in processes, such as those used in the chlor-alkali industry.

Desalting is, as the name implies, adapted to remove primarily inorganic salts from the crude prior to refining. The desalting step is provided by adding and mixing with the crude a few volume percentages of fresh water to contact the brine and salt.

In crude oil desalting, a water in oil (w/o) emulsion is intentionally formed with the water admitted being on the order of about 4–10 volume % based on the crude oil. Water is added to the crude and mixed intimately to transfer impurities in the crude to the water phase. Separation of the phases occurs due to coalescence of the small water droplets into progressively larger droplets and eventual gravity separation of the oil and underlying water phase.

Demulsification agents are added, usually upstream from the desalter, to help in providing maximum mixing of the oil and water phases in the desalter. Known demulsifying agents include water soluble salts, Twitchell reagents, sulfonated glycerides, sulfonated oils, acetylated caster oils, ethoxylated phenol formaldehyde resins, a variety of polyester materials, and many other commercially available compounds.

Desalters are also commonly provided with electrodes to impart an electrical field in the desalter. This serves to polarize the dispersed water molecules. The so-formed dipole molecules exert an attractive force between oppositely charged poles with the increased attractive force increasing the speed of water droplet coalescence by from ten to one hundred fold. The water droplets also move quickly in the electrical field, thus promoting random collisions that further enhance coalescence.

Upon separation of the phases from the W/O emulsion, the crude is commonly drawn off the top of the desalter and sent to the fractionator tower in crude units or other refinery processes. The water phase containing water soluble metal salt compounds and sediment is discharged as effluent.

Desalters are often employed in tandem arrangement to improve salt removal efficacy. Commonly, in such designs, crude oil from the resolved emulsion in the first desalter is used as crude feed to the downstream second desalter. Wash water is added to this crude separated from the emulsion in the first desalter with water phase bottoms effluent from the second desalter being fed back as make up water, mixed with the crude fed to the first desalter.

SUMMARY OF THE INVENTION

We have surprisingly found that, contrary to conventional wisdom, addition of a water soluble chelant directly to the crude followed by mixing of the chelant with the crude prior to addition of wash water, increases the iron removal capability of the desalter. The process is capable of improving removal of oil soluble, oil insoluble, and water soluble iron forms.

The chelant should be fed directly to the crude. Sufficient time is then given for the crude/chelant combination to adequately mix. Then, wash water is admitted to the mixed crude/chelant combination with the chelated iron moieties partitioning to the water phase. Upon resolution of the emulsion in a desalter, the water phase effluent containing water soluble chelated iron containing complexes is removed from the desalter.

A particularly advantageous use of the invention is made in conjunction with two-stage desalting systems of the type referred to supra. Here, the desalters are provided in tandem relationship. As is common, the bottoms water phase effluent from the downstream (second) desalter is recycled as make up water to be mixed with the crude fed into the upstream (first desalter). Also, as is usual, after resolution of the W/O emulsion in the first desalter, fresh make up water is mixed with crude separated from the upstream desalter prior to entry of the fresh wash water-crude admixture into the second desalter. In accordance with the present invention, however, the water soluble chelant is added to and mixed with the crude separated from the upstream (first) desalter. After the crude and chelant have had sufficient time for intimate mixing thereof, then the crude/chelant admixture is contacted with fresh wash water prior to entry into the second (downstream) desalter.

As to the water soluble chelants that may be used, a variety can be mentioned, such as ethylenediaminetetraacetic acid (EDTA), oxalic acid, citric acid, nitrolotriacetic acid (NTA), ethylenediamine (EDA), malonic acid, succinic acid, maleic acid, and salts thereof. Typically, these chelants are fed at molar ratios of about 1-5 mole chelant:1 mole of iron. These water soluble chelants are often dissolved in aqueous solution as sold in product form. Such aqueous based products may be fed directly to the crude, preferably after it exits from the first desalter in a two-stage desalter system but prior to (i.e., upstream) from addition of wash water to this separated crude from the first desalter.

PRIOR ART

Chelant addition to wash water for mixture with crude prior to entry of the emulsion into a desalter is known. Chelant chemistries, however, are not surface active and, as a result, the efficiency of contacting the chelant molecules with iron in the crude-water admixture is low, resulting in exorbitant and uneconomical chelant addition requirements.

In U.S. Pat. No. 4,853,109 (Reynolds), dibasic carboxylic acids, such as oxalic, malonic, succinic, maleic, and adipic acid are used as chelants to remove metals, primarily calcium and iron, from hydrocarbonaceous feedstocks. Here, in accordance with conventional wisdom, the feedstock is mixed with an aqueous solution of the dibasic carboxylic acid as opposed to direct feed of the chelant into the crude, followed by addition of water.

Iron sulfide deposits are removed from surfaces by contacting the surfaces with a basic aqueous solution of a chelating agent selected from citric acid, oxalic acid, and alkylene polyamine polyacetic acids in U.S. Pat. No. 4,276,185 (Martin). Other patents which may be of pertinence include U.S. Pat. No. 4,548,700 (Bearden et al) disclosing use of oxalic acid to extract metals from metallic ashes formed during slurry hydroconversion processes and U.S. Pat. No. 4,830,766 (Gallup et al) in which reducing agents, including oxalic acid, are used to contact geothermal brines containing trivalent metal cations, such as iron and manganese. U.S. Pat. No. 4,342,657 (Blair, Jr.) is also mentioned as being of possible, although probable tangential, interest only due to its broad disclosure of petroleum emulsion breaking processes.

The invention will now be further described in conjunction with the appended drawing and the detailed description.

DRAWING

In the drawing:

FIG. 1 is a schematic showing a two-stage desalter system in accordance with the invention.

DETAILED DESCRIPTION OF THE PREFERRED EMBODIMENT

Figure 1:
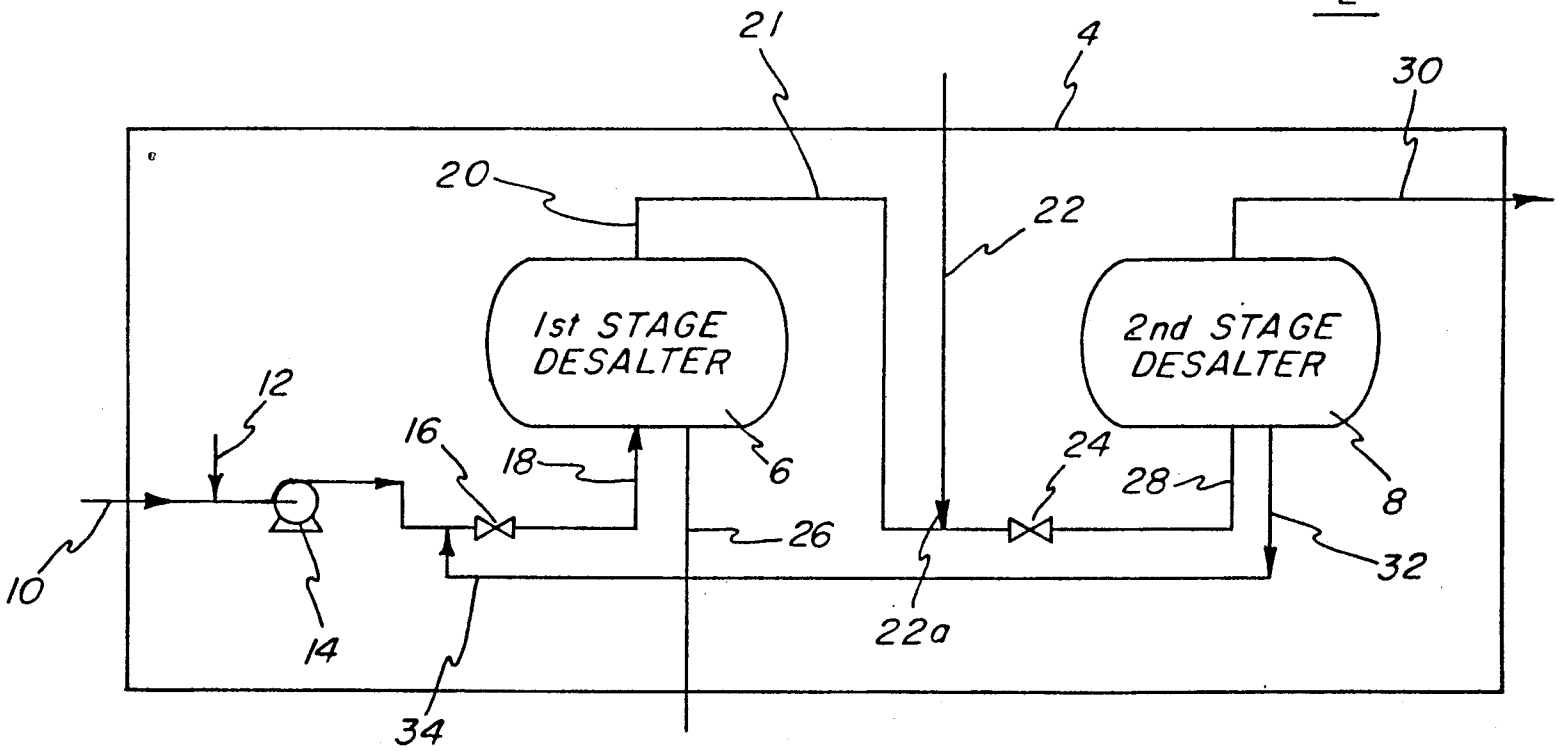

Turning to FIG. 1, there is shown a desalter system 2 comprising system housing 4 containing an upstream desalter 6 and downstream desalter 8 in tandem relationship. Desalters 6, 8 are of the type commonly encountered in industry, such as those manufactured by Petroco or Howe-Baker.

The specific constructional details of desalters 6, 8 are not important to the invention. However, it is noted that, ordinarily, the desalters are provided with electrodes to impart an electric current through the emulsion so as to aid in coalescence of the water droplets to facilitate resolution of the emulsion. Also, the desalters are provided with heat imparting means and pressure control means to respectively control temperature and pressure within the vessels.

Typically, desalter temperatures are maintained at 200°-300° F. Heat lowers the viscosity of the continuous phase (i.e., oil) therefore speeding the settlement of the coalesced water droplets as governed by Stokes Law. It also increases the ability of bulk oil to dissolve certain organic emulsion stabilizers that may have been added or are naturally occurring in the crude.

Desalter pressure is kept high enough to prevent crude oil or water vaporization. Vaporization causes water carry over into the crude oil leaving the desalter. Desalter pressure at operating temperatures should be about 20 psi above the crude oil or water vapor pressure, whichever is lower.

Emulsion breakers, also called demulsifiers, are usually fed to the crude so as to modify the stabilizer film formed initially at the oil/water interface. These emulsion breakers are surfactants that migrate to the interface and alter the surface tension of the interfacial layer allowing droplets of water (or oil) to coalesce more readily. These demulsifiers reduce the residence time required for good separation of oil and water.

As shown in the figure the distribution location for crude entry into both desalters 6, 8 is on the bottom side of the vessels. Other designs can be employed. The desired goal is to provide for uniform distribution of the crude into the vessel.

As shown, crude is fed at inlet 10 with emulsion breakers being fed at inlet 12 on the suction side of crude charge pump 14. Brine laden water effluent from second stage desalter 8 exiting through line 32 to inlet 34 is mixed with the crude/emulsion breaker admixture at mix valve 16. The mixed brine laden wash water/crude/emulsion breaker emulsion is admitted into the desalter 6 at bottom side distributor 18.

Upon resolution of the emulsion in first stage desalter 6, separated crude is drawn off the top of the vessel through line 21. Here, in accordance with the invention, water soluble chelants are admitted to the process line 21 at location 20 wherein chelant and crude are intimately mixed along process line 21. Addition of chelant to the crude at this location is important so as to allow for sufficient mixing prior to addition of fresh make up water from line 22. Additionally, injection of chelant into the crude discharged from the desalter 6 ensures that metal cations from water soluble salts, such as $Ca^{++}$ and $Mg^{++}$ salts are only minimally encountered. The water soluble chelants used in the invention complex these metal ions in addition to iron, so minimizing their concentration helps assure that the chelants can perform their intended function: to wit, forming complexes with the iron remaining in the crude.

The crude/chelant mixture in line 21 should be given as much mixing time as the particular system will permit before the addition of fresh wash water at location 22*a*. The more contact and time the chelant and iron have before water injection, the greater the iron removal efficiency gained by the process.

Mixing of the fresh water with the intimately blended admixture of crude and chelant is achieved by mix valve 24 positioned upstream from second stage desalter 8. The water/chelant/crude mixed emulsion is then admitted to the bottom of desalter 8, via distribution port 28, for uniform distribution throughout the entire vessel.

After resolution of the emulsion in desalter 8, iron laden brine is drawn off as underflow water based effluent through line 32 for aforementioned return as wash water to the crude/demulsifier charge at inlet 34. Crude having reduced iron content is drawn from desalter 8 via line 30 for subsequent refinery processing.

As to the demulsifiers that may be admitted to the system at inlet 12, these are well-known and may comprise any one of the generic chemical classes heretofore mentioned as well as others. These may be purchased, for instance, from Betz Process Chemicals, Inc., The Woodlands, Tex., under the trademarks Embreak ®2W191, Prochem ®2x22, Embreak ®2W801, Embreak ®2W151, Embreak ®2W113, Embreak ®2W901, Embreak ®2W116 and Prochem's DM-1332.

The water soluble chelants are preferably fed at rates of about 1-5 moles chelant:mole iron in crude. A host of water soluble chelants may be mentioned as being exemplary. For example, aminocarboxylic acids, such as ethylenediaminetetraacetic acid (EDTA), diethylenetriaminepentaacetic acid, N-2-hydroxyethylethylenediaminetriacetic acid, propylene 1,2-diamine tetraacetic acid, and the isometric butylenediaminetetraacetic acids, etc., may be mentioned along with nitrolotriacetic acid (NTA). Other chelants include amines, such as ethylenediamine (EDA), and acids, such as oxalic acid, citric acid, malonic acid, succinic acid, maleic acid and salts thereof are noted.

Based upon presently available considerations, it is preferred to use EDTA as the chelant, with the presently preferred composition comprising:

99.5% = tetrasodium salt of EDTA in water solution (38% active), 0.5% = anionic copolymer, Additionally, it is preferred to use the EDTA chelant in combination with conventional demulsifiers.

As used herein, iron means both elemental iron and iron containing compound forms that may be either soluble or insoluble in the crude.

EXAMPLE ONE

In order to assess the efficacy of the iron removal methods of the invention, iron removal tests were conducted on test crudes in a simulated desalter apparatus.

Description of Apparatus

The simulated desalter comprises an oil bath reservoir provided with a plurality of test cell tubes disposed therein. The temperature of the oil bath can be varied to about 300° F. to simulate actual field conditions. Electrodes are operatively connected to each test cell to impart an electric field of variable potential through the test emulsions contained in the test cell tubes.

Procedure

Crude oil ≈93.5% (volume) and water ≈6.5% (volume) were admitted to each test cell along with the candidate desalting materials. The crude/water mixtures were homogenized by blending prior to entry into each of the test cells. The oil bath was heated to a desired temperature and a predetermined electrical voltage was applied to the cells through insertion of an electrode into each cell. The cells were then permitted to remain in the oil bath for about 5 minutes. During this time, the tube contents were heated to approximately tank oil temperature. Power was applied to the electrodes according to a predetermined time schedule. Then, the water drop (i.e., water level) in ml was observed for each sample after the predetermined time intervals according to the schedule. 6 mls of the water phase were thieved from each cell after each screening so as to determine Fe content (and other constituents, if desired). 90 mls of the remaining crude in each cell was used to assess Fe (and other constituents, if needed) content. Iron content in both the crude and the thieved water (underflow water) was then measured by an induction coupled argon plasma emissions spectrometer.

Results are shown in Table I.

TABLE I

| Desalter Chemicals Used | Dosages ppm-Based on Crude | Crude Fe Out (ppm) | Water Fe Out (ppm) | Water Drop ml | Water Drop ml After Reshake |
|---|---|---|---|---|---|
| $EB_1$ | 12 | | 4.6 | | |
| $EB_1$/EDA | 6/6 | 5.4 | 1.1 | | |
| $EB_1$/EDA | 8/4 | 3.9 | 0.77 | 5.8 | 6.4 |
| $EB_1$/EDA | 9/3 | 5.9 | 0.74 | | |
| $EB_1$ | 18 | 6.8 | 1.30 | | |
| $EB_1$/EDA | 9/9 | 5.8 | 0.99 | | |
| $EB_1$/EDA | 12/6 | 4.7 | 0.75 | | |
| $EB_1$/EDA | 13.5/4.5 | 6.6 | 0.80 | | |
| $EB_1$ | 12 | 6.3 | 1.5 | | |
| $EB_1/EB_2$ | 6/6 | — | 2.6 | | |
| $EB_1/EB_2$ | 8/4 | 3.4 | 4.7 | 6.5 | 7.0 |
| $EB_1/EB_2$ | 9/3 | 4.0 | 5.9 | 7.0 | 7.0 |
| $EB_1$ | 18 | 5.1 | 3.0 | | |
| $EB_1/EB_2$ | 9/9 | 4.6 | 6.4 | | |
| $EB_1/EB_2$ | 12/6 | 4.5 | 2.6 | | |
| $EB_1/EB_2$ | 13.5/4.5 | 7.3 | 2.9 | | |
| $EB_1$ | 18 | 6.2 | 2.4 | | |
| $EB_1$ | 18 | 7.1 | 0.67 | | |
| $EB_1$/EDA | 9/9 | 4.8 | 2.5 | | |
| $EB_1$/EDA | 9/9 | 3.8 | 7.1 | 6.8 | 7.0 |
| $EB_1$/NaOH | 18/ph of wash water 10.5 | 4.7 | 2.0 | 7.0 | |
| $EB_1$/NaOH | 18/ph of wash water 10.5 | 3.5 | 1.9 | | |
| $EB_1/H_2SO_4$ | 18/ph of wash water 3.5 | 4.0 | 2.9 | 6.4 | 6.8 |
| oxalic acid | 20 | 5.2 | | | |
| $EB_1$ | 12 | 8.8 | 0.84 | | |
| $EB_1$/oxalic acid | 12/10 | 21.0* | 6.00 | | |
| $EB_1$/oxalic acid | 12/20 | 3.10 | 16.90 | 4.5 | 6.9 |
| $EB_1$/oxalic acid | 12/30 | 2.5 | 31.00 | 4.7 | 5.3 |
| EDTA | 20 | 2.8 | | 3.5 | 3.6 |
| $EB_1$/EDTA | 12/20 | 3.6 | 8.9 | 6.2 | 6.9 |
| $EB_1$/NaOH | 12/ph wash water 10.5 | 3.4 | 1.5 | 7.0 | 7.4 |

Control
iron in crude = 6.60 ppm
iron in wash water = 3.40 ppm
$EB_1$ = commercially available emulsion breaker Embreak ® 2W191 from Betz Process Chemical, Inc.
$EB_2$ = commercially available emulsion breaker 2 × 22 from Betz Process Chemical, Inc.
EDA = ethylenediamine
EDTA = ethylenediaminetetraacetic acid, disodium salt
*outlier

Discussion Table 1

In accordance with the test procedure, desalter efficacy is demonstrated by a decrease in the crude Fe out compared with the crude control and by an increase shown in the water out Fe content compared with the raw wash water Fe content. In several instances, as shown in the Table, pH control agents, specifically, NaOH or $H_2SO_4$, were added to the wash water until a specified pH was attained. This was done in an attempt to establish if the pH of the wash water had any bearing on iron removal efficacy.

As shown in the Table, in general, the combination of emulsion breaker plus EDA, EDTA, or oxalic acid resulted in a decrease in Fe measured in crude with, in most cases, an increase in water out Fe being shown. Water drop measurements, when made in conjunction with the EDA, oxalic acid, or EDTA tests were acceptable demonstrating adequate resolution of the emulsions.

EXAMPLE TWO

Additional field tests were undertaken in conjunction with a two-stage desalter of the type shown in FIG. 1. Results are shown in Table II.

TABLE II

| Data Point Material Added | Addition Location (see FIG. 1) | Dose (PPM) | Raw Crude Fe (PPM) | Raw Water Fe (PPM) | 1st Out Crude Fe (PPM) | 1st Out Water Fe (PPM) | 2nd Out Crude Fe (PPM) | 2nd Out Water Fe (PPM) |
|---|---|---|---|---|---|---|---|---|
| 1 A | | 12 | 9.90 | 0.57 | | 2.30 | 3.70 | 0.83 |
| 2 $EB_1$ | | 14 | 4.80 | 0.50 | 5.20 | 1.00 | 12.20 | 1.80 |
| 3 $EB_1/EB_3$ | | 13/11 | 4.60 | 0.93 | 6.00 | 3.80 | 4.40 | 26.00 |
| 4 $EB_1/EB_3$/ EDTA | | 12/12/28 | 6.60 | 1.40 | 7.80 | 13.10 | 6.40 | 15.00 |
| 5 $EB_1/EB_3$/ EDTA | | 14/10/42 | 13.00 | 0.60 | 8.20 | 13.60 | 4.80 | 9.10 |

| Data Point Material Added | 1st Stg Fe Removal EFF (%) | 2nd Stg Fe Removal EFF (%) | Overall Fe Removal EFF (%) | 2nd Stg Water Fe Inc (%) | 1st Stg Water Fe Inc (%) | Overall Water Fe Inc (%) |
|---|---|---|---|---|---|---|
| 1 A | | ERR | 62.63* | 45.61* | 177.11* | 303.51* |
| 2 $EB_1$ | −8.33 | −134.62 | −154.17 | 260.00 | −44.44 | 100.00 |
| 3 $EB_1/EB_3$ | −30.43 | 26.67 | 4.35 | 2695.70 | −85.38 | 308.60 |
| 4 $EB_1/EB_3$/ EDTA | −18.18 | 17.95 | 3.03 | 971.43 | −12.67 | 835.71 |
| 5 $EB_1/EB_3$/ EDTA | 36.92 | 41.46 | 63.08 | 1416.67 | 49.45 | 2166.67 |

*conventional treatment program removing iron as oily sludge with the brine water. In contrast, the present invention functions with essentially oil-free brine water.
A = conventional emulsion breaker
$EB_3$ = Embreak ® 2W801

Discussion Table II

For data point #1, the iron is reduced by removing particulate inorganic iron in the form of oily solids in the desalter brine water. In data point #2, the desalter is operated with a conventional emulsion breaker to produce oil-free effluent water from the desalters. In data point #3, the conventional emulsion breaker is supplemented with a wetting agent added to help de-oil inorganic solids and help transfer them from the crude oil to the effluent water in an oil-free state. Virtually no oil was leaving with the brine water.

In contrast, for data point #4, the invention was practiced in conjunction with the treatment program listed for data point #3. While iron removal did not appear to increase at this time, Fe content in the desalter effluent waters for the first and second stage desalters increased dramatically indicating transfer of iron from the crude phase to the water phase. In data point #5, the invention was practiced similar to data point #4. The major change was an increase in the EDTA product applied. EDTA product (38% actives) dose was increased from 28 ppm to 42 ppm (based on crude charge). Here, the iron removal results were remarkable. Iron removal from the crude oil increased dramatically while the iron increase in the desalter effluent waters increased significantly compared to data point #4—indicating performance of the invention.

While this invention has been described with respect to particular embodiments thereof, it is apparent that numerous other forms and modifications will be obvious to those skilled in the art. The appended claims generally should be construed to cover all such obvious forms and modifications which are within the true spirit and scope of the present invention.

We claim:

1. In a two-stage desalting system having an upstream and downstream desalter and wherein a crude oil/water emulsion is formed and resolved in said upstream desalter with crude separated from said upstream desalter being fed to said downstream desalter, a method for decreasing iron content of said crude comprising, mixing a water soluble chelant with said crude after separation of said crude from said upstream desalter, subsequently mixing said separated crude with fresh wash water, feeding said separated crude and water to said downstream desalter to form an emulsion in said second desalter, and removing crude oil having diminished iron content from said second desalter.

2. Method as recited in claim 1 wherein from about 1-5 moles of said water soluble chelant are mixed with said separated crude based upon moles of iron in said crude oil in said first desalter.

3. Method as recited in claim 2 wherein said water soluble chelant is an aminocarboxylic acid.

4. Method as recited in claim 3 wherein said aminocarboxylic acid comprises a member selected from the group consisting of ethylenediaminetetraacetic acid, diethylenetriaminepentaacetic acid, N-2-hydroxyethylenediaminetriacetic acid, propylene 1,2-diaminetetraacetic acid, butylenediaminetetraacetic acid, nitrolotriacetic acid and salts of these acids.

5. Method as recited in claim 1 wherein said water soluble chelant comprises an acid selected from the group consisting of oxalic, citric, malonic, succinic, and maleic acid and salts thereof.

6. Method as recited in claim 1 wherein said water soluble chelant comprises a member selected from the group consisting of ethylenediaminetetraacetic acid (EDTA), ethylenediamine, and oxalic acid and salts thereof.

7. Method as recited in claim 6 wherein said chelant comprises EDTA.

8. Method as recited in claim 7 wherein said EDTA is dissolved in aqueous solution.

9. Method as recited in claim 6 wherein said chelant comprises ethylenediamine.

10. Method as recited in claim 6 wherein said chelant comprises oxalic acid.

11. Method as recited in claim 1 further comprising adding a demulsifying agent to said crude oil to help demulsify said emulsion formed in said upstream desalter.

12. Method as recited in claim 1 further comprising separating iron laden water phase from said emulsion in said second desalter and feeding said iron laden water phase to said upstream desalter.

* * * * *